US006904657B2

(12) United States Patent
Mann

(10) Patent No.: US 6,904,657 B2
(45) Date of Patent: Jun. 14, 2005

(54) BRITTLE WIRE EXTRUSION METHOD AND APPARATUS

(75) Inventor: Len E. Mann, Cornelius, NC (US)

(73) Assignee: Polymet Corporation, Cincinnati, OH (US)

( * ) Notice: Subject to any disclaimer, the term of this patent is extended or adjusted under 35 U.S.C. 154(b) by 145 days.

(21) Appl. No.: 10/134,582

(22) Filed: Apr. 29, 2002

(65) Prior Publication Data

US 2003/0200642 A1 Oct. 30, 2003

(51) Int. Cl.[7] ..... B23P 17/00

(52) U.S. Cl. ..... 29/423; 72/255; 72/272; 428/577

(58) Field of Search ..... 428/577; 29/423, 29/424, 419.1; 228/173.5; 72/255, 272

(56) References Cited

U.S. PATENT DOCUMENTS 2,050,298 A * 8/1936 Everett ..... 29/423
2,955,709 A * 10/1960 Sejournet ..... 72/255
3,160,951 A * 12/1964 Markert, Jr. et al. ..... 29/423
3,394,213 A * 7/1968 Roberts et al. ..... 29/419.1
3,413,707 A * 12/1968 Klein et al. ..... 29/423
3,553,829 A * 1/1971 Hunt et al. ..... 29/423
3,564,566 A * 2/1971 Heitman ..... 29/423
3,602,977 A * 9/1971 Huet et al. ..... 29/423
3,823,463 A * 7/1974 Weaver et al. ..... 29/423
3,837,066 A * 9/1974 Mori et al. ..... 29/599
4,131,461 A * 12/1978 De Pierre et al. ..... 29/424
4,186,586 A * 2/1980 Takamura et al. ..... 29/423
4,209,122 A * 6/1980 Hunt ..... 228/173.5
4,521,360 A * 6/1985 Fiorentino ..... 72/273
4,606,884 A * 8/1986 Gavinet et al. ..... 419/27
4,699,657 A * 10/1987 DiGiambattista ..... 72/272
4,777,710 A * 10/1988 Hunt ..... 29/419.1
5,007,577 A * 4/1991 Nakasuji et al. ..... 228/265
5,124,214 A * 6/1992 Cacace ..... 428/577
6,308,392 B1 * 10/2001 Mann et al. ..... 29/424

* cited by examiner

*Primary Examiner*—David P. Bryant
(74) *Attorney, Agent, or Firm*—Frost Brown Todd, LLC

(57) ABSTRACT

A method and apparatus is presented for the manufacture of brittle wire by the co-extrusion, or filled billet method. The invention involves a step by step method by which a billet can is specially prepared with a chamfered front end and a concave, collapsible front plate and a uniquely vented rear end. The result is a superior process in which bursting of the can and front end is eliminated, thereby resulting in a superior product, increased yield, improved safety and the like.

26 Claims, 3 Drawing Sheets

BRITTLE WIRE EXTRUSION METHOD AND APPARATUS

CROSS REFERENCE TO RELATED PATENT APPLICATIONS

There are no related pending patent applications filed by me.

BACKGROUND OF THE INVENTION

I. Field of the Invention

This invention is in the general field of manufacture of metallic wires;

The invention is more particularly in the field of manufacture of wire and other elongate members from high performance brittle alloys;

The invention is even more directly in the field of manufacture of such products by specialized, novel, unique and useful variations involved in the filled billet extrusion technique.

II. Description of the Prior Art

There is considerable prior art in this field. The following United States Patents reveal the state of the art prior to my present invention:

- U.S. Pat. No. 4,209,122 discloses a method of making high performance alloy wire;
- U.S. Pat. No. 3,788,820 discloses the making of high performance alloy members by the Filled Billet Extrusion Method;
- U.S. Pat. No. 3,394,213 discloses the production of fine filaments through an interesting process involving some of the known extrusion processes and an acid solution process;
- U.S. Pat. No. 4,606,884 combines a number of pressing, machining and acid solution steps;
- U.S. Pat. No. 2,050,298 defines a process for reducing rods, wires, etc. by surrounding preforms with a brittle filler and performing a number of physical steps without using acid;
- U.S. Pat. No. 4,209,122 defines a process to produce high performance alloy wires, etc. utilizing the principles set forth in many of the foregoing patents;
- U.S. Pat. No. 4,777,710 includes the features of U.S. Pat. No. 4,209,122 particularly utilizing a chromium filler powder in the process; and
- U.S. Pat. No. 6,308,392 B1, of which I am a co-inventor, represents a major step forward in this art.

None of the prior art has solved a particularly costly deficiency in this art which is the bursting of the can used in this art due to collapse of the block nose during the extrusion.

SUMMARY OF THE INVENTION

High performance brittle alloy wires and the like are used extensively in various critical manufacturing processes and the like. They are particularly used in critical welding of various sensitive items, such as in aircraft welding and the like.

As will be understood by those skilled in the art, critical components must be addressed with the highest regard for performance and reliability since safety is a prime consideration. As a result, those engaged in production of high performance brittle alloy items are constantly seeking even the most minute improvement and innovation in manufacturing methods and the like.

I have previously mentioned some of the most important prior art in this field. Considering all of the innovations and improvements heretofore developed, I have still found deficiencies in the processes concerned. Particularly, the processes disclosed in the patents mentioned above, including U.S. Pat. No. 6,308,392 B1 of which I am a co-inventor fail to solve some severe deficiencies in this particular field. Those deficiencies include frequent bursting of the can used in this art due to collapse of the block nose during the extrusion; low yield of actual usable final product as compared to amount of untreated product actually required; excessive labor and operations required to finish the product of the co-extrusion process; danger of injury to personnel and machinery; excessive cost of finished product produced; and associated deficiencies. I have conceived and perfected solutions to these problems which are disclosed in this specification. The solutions are primarily related to unobvious, novel, unique and useful can design and product assembly and processing techniques.

It is an object of this invention to provide an improved and economical method for the manufacture of brittle alloy elongate shapes by the brittle wire co-extrusion method wherein the tendency of the can used in this process to burst during the extrusion is eliminated;

Another object of this invention is to eliminate excessive waste in collapse and bursting of cans used in this extrusion process;

Another object of this invention is to avoid injury to persons and materials due to release of molten metal and impurities involved in collapsing and bursting of cans used in this extrusion process;

Another object of this invention is to provide such methods and means wherein there is a minimum of lost product due to the necessity of machining or other treatment of surfaces of salvaged material after collapsing and bursting of cans used in this extrusion process;

Another object of this invention is to minimize labor requirements in such method;

Another object of this invention is to maximize the quality of the brittle alloy products produced;

Another object of this invention is to maximize the quantity of the brittle alloy products produced;

Another object of this invention is to minimize the cost of the brittle alloy products produced.

The foregoing and other objects and advantages of this invention will be clear to those skilled in the art upon reading the following description of preferred embodiments in conjunction with a review of the appended drawings.

DESCRIPTION OF A PREFERRED EMBODIMENT

Figure 1:
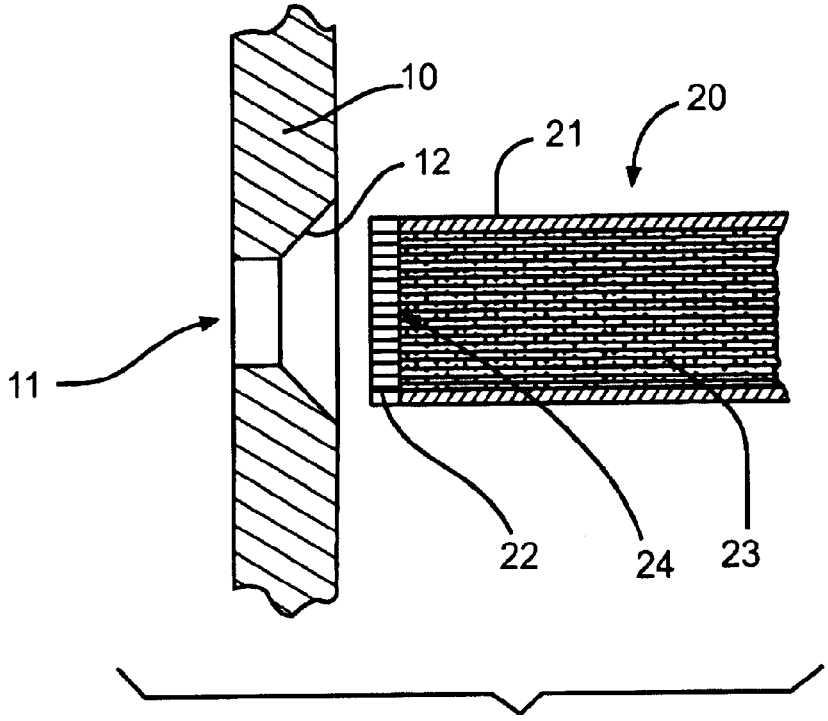
FIG. 1 Prior Art
FIG. 1 is a broken away schematic section of a billet according to the prior art about to enter an extrusion die.

The items having reference numerals in the drawings are:

| Numeral | Item |
|---|---|
| 10 | extrusion die |
| 11 | die orifice |
| 12 | chamfered entry to die orifice |
| 20 | billet according to prior art |
| 21 | can |
| 21a | ruptured can wall |
| 22 | front end plate |
| 22a | burst front end plate |
| 23 | rods and powder |
| 23a | reduced diameter rods |
| 23b | molten rods exiting ruptured can |
| 24 | area immediately behind front end plate |
| 25 | molten material |
| 50 | extrusion die |
| 51 | die orifice |
| 52 | chamfered entry to die orifice |
| 60 | billet according to present invention |
| 61 | can |
| 61a | reduced diameter can |
| 62 | concave front end plate |
| 62a | collapsed front end plate |
| 63 | rods and powder |
| 63a | reduced diameter rods |
| 64 | front of billet behind collapsed concave front end plate |
| 65 | chamfered can front end |
| 66 | cropped rear end of billet |
| 66a | crop line |
| 67 | rear end plate |
| 68 | vent holes |
| 69 | vent holes |
| 70 | chamfered edge and weld of rear end plate |

This invention consists of improvements and innovations in the filled billet extrusion method, which method, prior to the invention disclosed in the previously mentioned U.S. Pat. No. 6,308,392 B1 is well known to those skilled in the art. For this reason and in the interests of expediency, full details of the filled billet extrusion method will not be listed, but only those portions necessary for a complete understanding of the novel features of my invention.

In FIG. 1 a portion of a billet 20 including a nose plate 22 about to enter a die 10 for extrusion through the die orifice 11 a customary manner. The entry to the die orifice is chamfered 12. The entire billet 20 will be forced through the die orifice an hydraulic ram or the like as is known to those skilled in the In extruding the billet in this manner the goal is that the meter of the can 21 will be reduced 21*a* and elongated and that rods 23 in metallic and other powder will likewise be reduced and elongated 23*a*.

Figure 2:
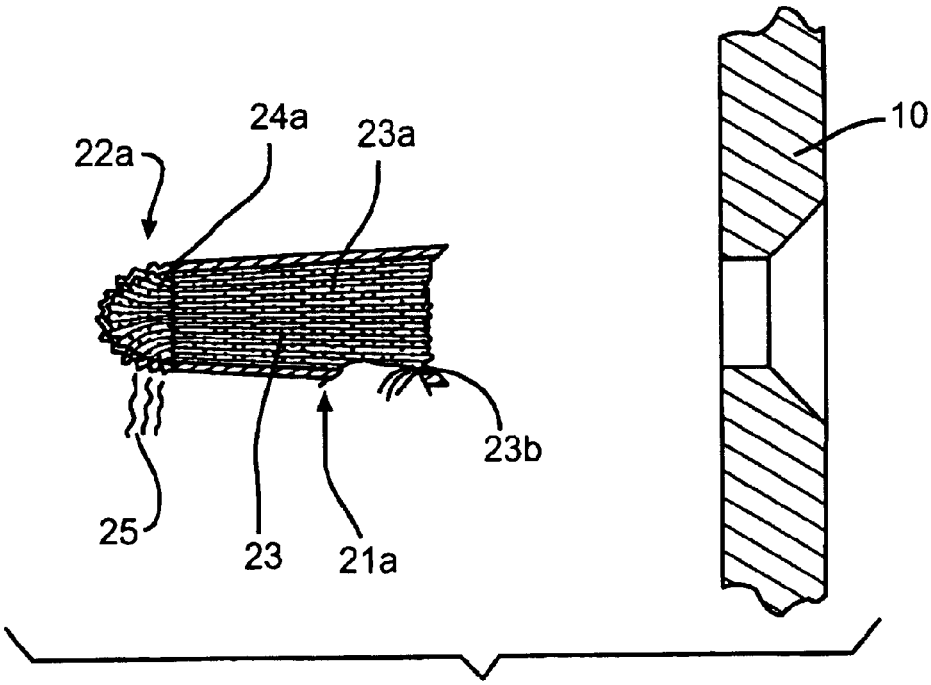
FIG. 2 Prior Art
FIG. 2 is a broken away schematic section of the nose of the billet of FIG. 1 according to the prior art showing bursting after passing through the extrusion die.

FIG. 2 shows what actually happens in a great number of cases. The front plate 22 is distorted and bursts 22*a* causing the virtual explosion of the front end with dangerous and costly release of gases and molten material 25. Additionally the can will rupture along its length 21*a* and rods and other material 23*b* will be discharged. Such items are ruined and cannot be reclaimed. Additionally, there is great danger to personnel, buildings and equipment since these forces are very great and become totally explosive.

Figure 3:
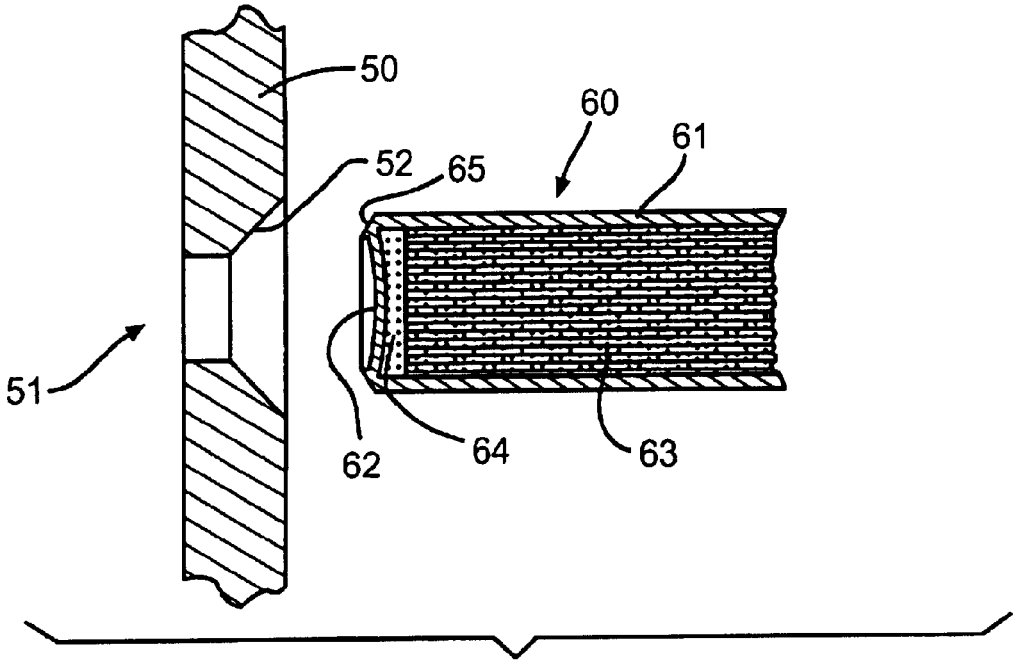
FIG. 3 is a broken away schematic section of a billet according to my present invention about to enter an extrusion die.
Figure 4:
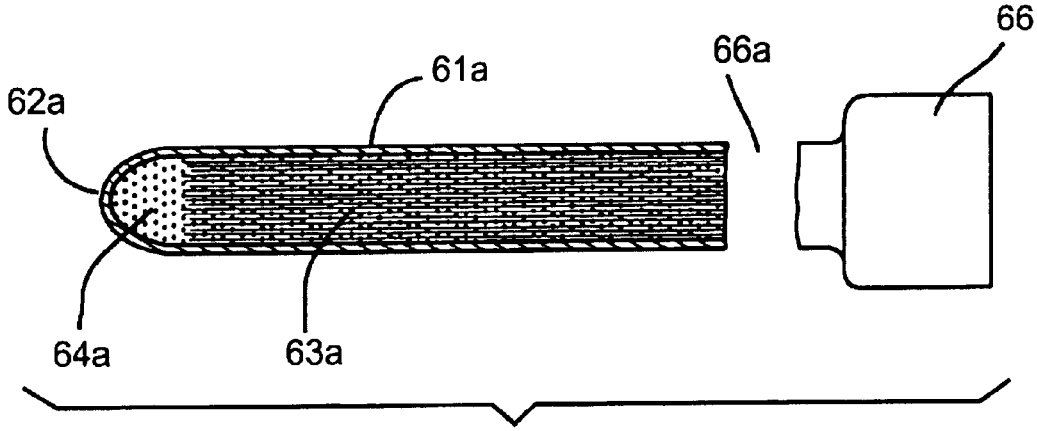
FIG. 4 is a schematic section of the billet of FIG. 3 according to my present invention after passing through the extrusion die.
Figure 5:
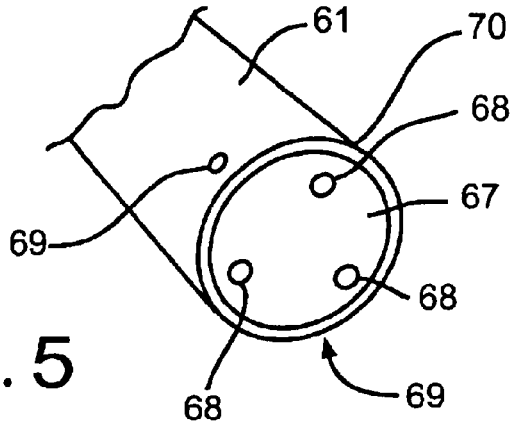
FIG. 5 is a schematic broken away perspective of the rear of the billet of FIG. 3 showing vent holes according to this invention.
Figure 6:
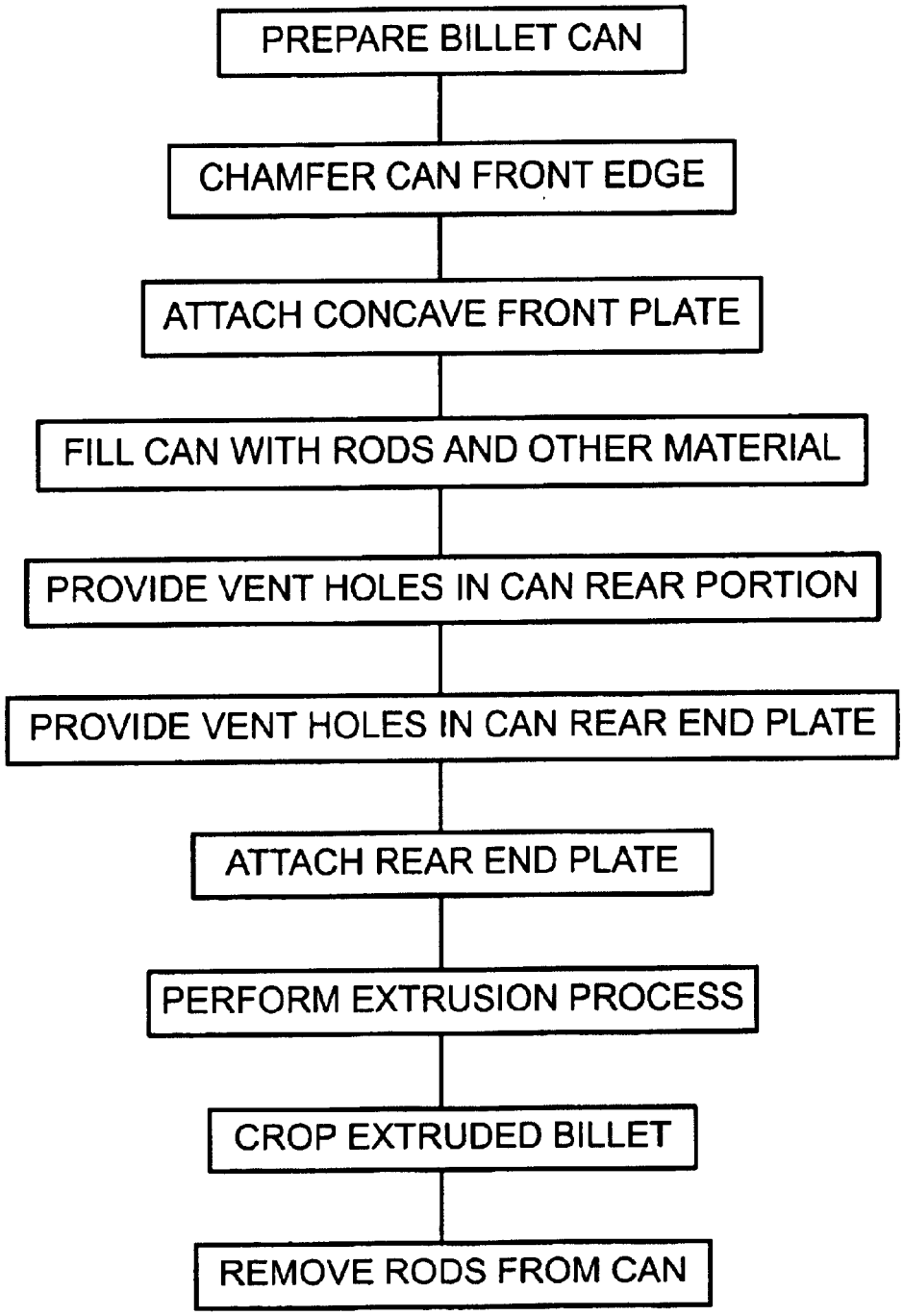
FIG. 6 is a block diagram of a method in accordance with the present invention.

FIGS. 3, 4, and 5 illustrate the features of my new invention. The invention consists of special shaping of the front end of the can and the front end closure, and special venting at the rear of the can.

The die 50 and die orifice 51 are unchanged from the prior art. However, the new billet 60, can 61, and the concave front end plate 62 have revolutionized this procedure. I have chamfered 65 the front end of the can 61 to match the chamfer of the entry 52 to the die orifice. I have also secured (by welding or the like) the concave front plate 62 to the interior of the can and at a slight distance behind the front chamfer 65 of the can. I also provide a defined space filled with metallic powder or the like 64 between the front end plate and the ends of the rods 63.

The result of these novel, unique and useful inventions is that the front end of the billet collapses as shown at 62*a* with the powder 64*a* forming a buffer to the rods now reduced and elongated 63*a* within the reduced and elongated can 61*a*. The successfully extruded elongated rods 63*a* and can 61*a* are now cropped, or severed at 66*a* adjacent the die orifice as is known to those skilled in the art from the small length 66 of the rear of the original billet.

The rods 63*a* are now removed from the can as described in U.S. Pat. No. 6,308,392 B1 or other suitable manner as is known to those skilled in the art.

In addition to my new process involving the front end of the billet as previously described, I have discovered that special formation of vent holes at the rear of the billet gives additional benefits and improves the performance, yield, and safety of this process. It has been customary to provide a single vent hole in the rear plate 67 of the can. However, I have carefully calculated the formation of gases within the billets and have found that much better venting and performance can be achieved by spacing three vent holes 68 in the rear end plate 67 around the perimeter and near the inner surface of the can as shown in FIG. 5. Also, two vent holes 69 (one vent 69 indicated by an arrow is not visible) through the can 61 provide additional beneficial results. All of these vents can be of varying sizes which can be determined empirically to accommodate the exact conditions of size and make up of the cans, rods, powders, and the like for any particular extrusion.

It is to be understood that the loading, preparation, treatment and the like of the rods and other matter into the can as well as the removal after extrusion are, except as otherwise described above, routine and known to those skilled in the art and exemplified in the various patents referenced above.

The claims and abstract which follow are incorporated herein as a part of the disclosure the same as though fully set forth again.

While the embodiments of this invention shown and described are fully capable of achieving the objects and advantages desired, it is to be understood that they have been shown for purposes of illustration only and not for purposes of limitation.

In the claims which follow if I should omit to claim patentable feature of this invention such failure is due to inadvertence an not due to any intent to dedicate or abandon such feature. In such event upon learning of such omission I shall immediately take any appropriate and authorized action to cure such omission, and claim such feature.

I claim:

1. A method for extruding a billet comprising the steps of: forming a cylindrical billet can having a front end with an exterior chamfer which is the same degree as the chamfer of an opening to an extrusion die to be used in the performance of a filled billet manufacturing process; closing the front end of the billet can with a concave end plate; filling the billet can with rods and powders suitable to be used in a filled billet manufacturing process; closing the rear end of the can with a multi-vented plate; extruding a portion of the billet can through the extrusion die; severing the extruded portion from a remainder of the billet can; and removing the rods from the severed portion.

2. A method of extruding a billet comprising the steps of: preparing a billet can having a front and a rear by chamfering the leading edge of the can to correspond to the chamfer leading to the orifice of the extrusion die to be used; attaching a concave front plate to the interior of the chamfered front or leading edge of the can; filling the can in a customary manner with rods and powder; providing two diametrically opposed vent holes adjacent the rear of the can; providing a rear closure plate having three equally spaced vent holes adjacent the perimeter of the rear closure plate; attaching said rear plate to the rear interior of the can; extruding a portion of the can through the extrusion die; cropping the un-extruded portion of the can from the extruded portion; removing the extruded rods from the extruded portion; and finishing the extruded rods.

3. A billet, comprising:

(a) a billet can, the billet can comprising:
  (i) a side exterior surface,
  (ii) a rear end,
  (iii) a front end,
  (iv) a leading edge at the front end, the leading edge being chamfered to complement a chamfered opening in an extrusion die through which the billet can is to be extruded;

(b) a plurality of rods in the billet can, each rod having a distal end and a proximal end;

(c) powder in the billet can; and (d) a concave front end plate in the billet can proximate to the distal ends of the rods.

4. The billet of claim 3, wherein powder is between the concave front end plate and the distal ends of the rods.

5. The billet of claim 3, wherein the concave front end plate is recessed relative to the chamfered leading edge of the billet can.

6. The billet of claim 3, further comprising a rear plate having a plurality of vent holes, the rear plate being positioned at the rear end of the billet can.

7. The billet of claim 6, said vent holes being spaced equidistantly relative to each other.

8. The billet of claim 3, further comprising one or more vent holes in the side exterior surface of the billet can proximate to the rear end of the billet can.

9. A billet, comprising:

(a) a billet can, the billet can comprising:
  (i) a side exterior surface,
  (ii) a rear end,
  (iii) a front end,
  (iv) a leading edge at the front end, the leading edge being chamfered to complement a chamfered opening in an extrusion die through which the billet can is to be extruded;

(b) a plurality of rods in the billet can, each rod having a distal end and a proximal end;

(c) powder in the billet can; and (d) a rear plate having a plurality of vent holes, the rear plate being positioned at the rear end of the billet can.

10. The billet of claim 9, wherein said vent holes are spaced equidistantly relative to each other.

11. The billet of claim 9, further comprising one or more vent holes in the side exterior surface of the billet can proximate to the rear end of the billet can.

12. The billet of claim 9, further comprising a concave front end plate proximate to the distal ends of the rods.

13. The billet of claim 12, wherein powder is between the concave front end plate and the distal ends of the rods.

14. The billet of claim 12, wherein the concave front end plate is recessed relative to the chamfered leading edge of the billet can.

15. A method of extrusion, comprising the steps of:

(a) chamfering the leading edge of a cylindrical billet can having a side exterior surface, a front end, and a back end, the chamfer being complementary to a chamfered opening in an extrusion die;

(b) closing the front end of the billet can with a concave front end plate;

(c) filling the billet can with rods and one or more powders;

(d) closing the rear end of the billet can with a rear end plate;

(e) extruding a portion of the billet can through the extrusion die;

(f) severing the extruded portion from a remainder of the billet can; and (g) removing the rods from the extruded portion.

16. The method of claim 15, said front end plate being recessed relative to the leading front edge.

17. The method of claim 15, further comprising adding powder to the front end of the billet can behind the front end plate.

18. The method of claim 15, said rear end plate having a plurality of vent holes.

19. The method of claim 18, wherein said vent holes are spaced apart equidistantly.

20. The method of claim 15, further comprising forming one or more holes in the side exterior surface of the billet can proximate to the back end.

21. A method of extrusion, comprising the steps of:

(a) chamfering the leading edge of a cylindrical billet can having a side exterior surface, a front end, and a back end, the chamfer being complementary to a chamfered opening in an extrusion die;

(b) closing the front end of the billet can with a front end plate;

(c) filling the billet can with one or more powders and rods;

(d) closing the rear end of the billet can with a rear end plate, the rear end plate having a plurality of vent holes;

(e) extruding a portion of the billet can through the extrusion die;

(f) severing the extruded portion from a remainder of the billet can; and removing the rods from the extruded portion.

22. The method of claim 21, wherein the vent holes are spaced apart equidistantly.

23. The method of claim 21, further comprising forming one or more holes in the side exterior surface of the billet can proximate to the back end.

24. The method of claim 21, the front end plate being concave.

25. The method of claim 21, the front end plate being recessed relative to the leading front edge.

26. The method of claim 21, further comprising adding powder to the front end of the billet can behind the front end plate before filling the billet can with rods.

* * * * *